US005755277A

United States Patent [19]

Appel et al.

[11] Patent Number: 5,755,277

[45] Date of Patent: May 26, 1998

[54] HEAT EXCHANGER

[75] Inventors: Cornelis Appel; Wouter Detlof Berggren, both of The Hague, Netherlands

[73] Assignee: Shell Oil Company, Houston, Tex.

[21] Appl. No.: 721,713

[22] Filed: Oct. 4, 1996

[30] Foreign Application Priority Data

Oct. 6, 1995 [EP] European Pat. Off. ..... 95202693

[51] Int. Cl.[6] ..... F28F 9/10

[52] U.S. Cl. ..... 165/81; 165/158; 165/174

[58] Field of Search ..... 165/158, 81, 174, 165/176

[56] References Cited

U.S. PATENT DOCUMENTS

| | | | |
|---|---|---|---|
| 2,857,142 | 10/1958 | Gertzon | 165/158 |
| 2,956,704 | 10/1960 | Boni, Jr. | 165/158 X |
| 4,325,428 | 4/1982 | Schuurman | 165/158 X |
| 4,473,112 | 9/1984 | Noe et al. | 165/158 |
| 4,750,554 | 6/1988 | Oeij et al. | 165/158 |
| 5,538,261 | 7/1996 | Murray et al. | 165/173 X |

FOREIGN PATENT DOCUMENTS

| | | |
|---|---|---|
| 2360238 | 4/1973 | Germany . |
| 4341268 A1 | 8/1995 | Germany . |

*Primary Examiner*—Leonard R. Leo

[57] ABSTRACT

A heat exchanger is provided having a shell, tubes, a tubesheet, partition box having a ring, and compression bolts. The heat exchanger includes resilient elements of compacted graphite or compacted carbon-graphite which are located between the ends of the compression bolts and the partition-box ring to aid in preventing leakage during changes in operating conditions.

3 Claims, 1 Drawing Sheet

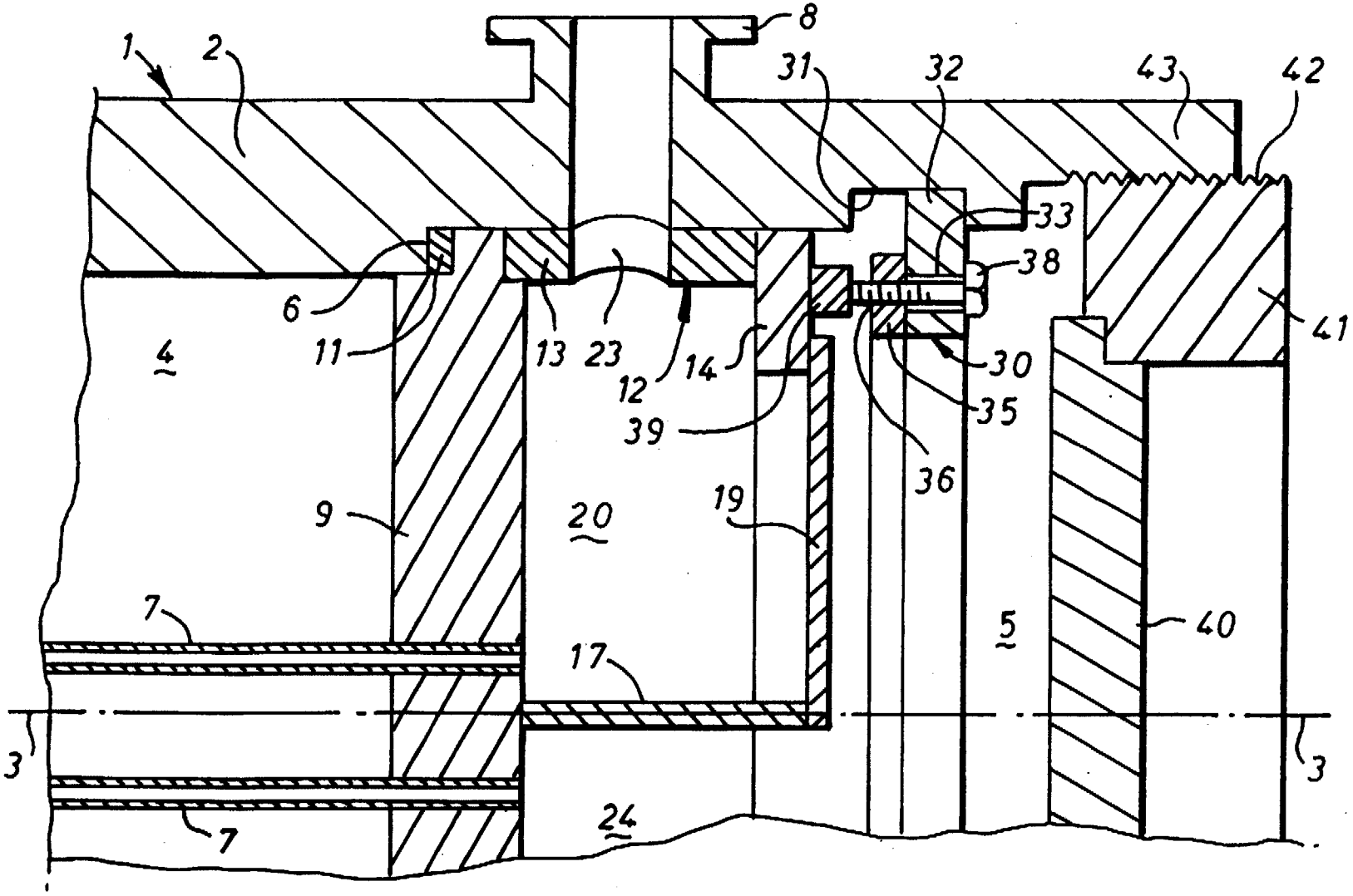
42
41
3
43
40
33
38
30
35
5
32
36
8
31
19
14
39
12
23
20
17
24
13
11
6
9
2
1
4
7
7
3

HEAT EXCHANGER

FIELD OF THE INVENTION

The present invention relates to a heat exchanger of the shell-and-tube type and in particular to a heat exchanger for high pressures and high temperatures.

BACKGROUND

The typical heat exchanger comprises a circle-cylindrical shell defining a heat-exchange part closed at one end in which heat-exchange tubes are arranged and an open-ended front-end part having an internal diameter which is larger than the internal diameter of the heat-exchange part and being separated therefrom by a rim, a tube sheet located in the front-end part against the rim, a partition box located in the front-end part against the tube sheet comprising a sleeve and a partition-box ring, a key-ring assembly arranged in an annular groove in the shell at the front-end part and provided with threaded passages, a plurality of compression bolts arranged through the threaded passages in the key-ring assembly of which the free ends extend to the partition-box ring, a front-end cover, and fastening means for securing the front-end cover in the open end of the front-end part.

During normal operation, heat is exchanged between fluid flowing through the heat-exchanger part of the shell and fluid flowing through (inside) the tubes. In this specification the term "shell fluid" is used to refer to fluid flowing through the heat-exchanger part of the shell and the term "tube fluid" is used to refer to fluid flowing through the tubes.

The shell fluid enters into the heat-exchange part of the shell through an inlet nozzle arranged in the shell, flows around the heat-exchange tubes in the heat-exchange part, and leaves the heat-exchange part of the shell through an outlet nozzle arranged in the shell.

The tube fluid enters into the heat exchanger through an inlet nozzle arranged in the front-end part of the shell which inlet nozzle communicates with an inlet chamber of the partition box, and flows into the ends of heat-exchange tubes facing the inlet chamber. Subsequently the tube fluid flows out of the end parts of heat-exchange tubes facing an outlet chamber of the partition box, and the tube fluid leaves the heat exchanger through an outlet nozzle arranged in the front-end part which communicates with the outlet chamber of the partition box. The heat-exchange tubes can be U-shaped, wherein the end parts of the tubes are fixed in the tube sheet in such a way that the inlet ends of the heat-exchange tubes communicate with the inlet chamber of the partition box and that the outlet ends of the heat-exchange tubes communicate with the outlet chamber of the partition box. Alternatively the heat-exchange tubes can be straight extending from the tube sheet to a second tube sheet at the other end of the heat-exchange part provided with a header so that fluid flowing out of the tubes communicating with the inlet chamber is passed to tubes communicating with the outlet chamber of the partition box.

To prevent fluid from leaking out of the heat-exchange part into the front end of the heat exchanger, there is usually provided a seal of packing material between the tube sheet and a rim against which the tube sheet is arranged. By tightening compression bolts, the force with which the tube sheet is pressed against the seal can be increased.

The compression bolts are tightened before operation with a pre-determined torque, so that during normal operation the force with which the tube sheet is pressed against the seal is sufficient to prevent leakage of the packing material arranged between the rim and the tube sheet. In determining the torque required are taken into account the lengths at steady-state operating conditions of the construction elements between the rim and the annular groove. These construction elements include the front-end part between the rim and the annular groove, the partition box and the compression bolts.

During a change in operating conditions or during start-up the lengths of all construction elements will change, and these changes in length will be different from the final changes attained at steady-state operating conditions. This phenomenon is particularly pronounced during start-up of the heat exchanger when, for example, the partition box heats up more quickly than the front-end part of the shell so that the partition box wants to expand more than the front-end part. Consequently, the partition box gets compressed. As long as the compressive stresses are in the elastic domain the length of the partition box will arrive at its design length when steady-state operating conditions are attained. Thus the force with which the tube sheet is pressed against the seal is not affected. However, when the compressive stresses in the partition box are in the plastic domain, the partition box will not arrive at its design length at steady-state operating conditions, but it will remain shorter. This shortening is permanent, and is also called permanent set. Consequently the seal at the tube sheet may start to leak. The effect of differences in thermal expansion has been explained with reference to the partition box, however, this can as well apply to other construction elements.

One way of overcoming problems associated with differences in thermal expansion is shown in U.S. Pat. No. 4,750,554. This publication discloses that the heat exchanger further comprises resilient elements in the form of a bolt seating ring located between the ends of the compression bolts and the partition-box ring. The bolt seating ring can deform to protect the heat exchanger from the effects of stresses that result from differences in thermal expansion.

The publication is silent on the design of the bolt seating ring, nor does it disclose which material had been used. It has been found that the type of material used is critical. For example, it was found that disc springs have a load-deformation characteristic which makes them not suitable for application in a heat exchanger; the deformation of the disc spring resulting from thermal expansion would generate such a high load on the disc spring that a relatively large disc spring would be required, however, the space in the heat exchanger does not allow using a relatively large disc spring.

It is an object of the present invention to provide a heat exchanger wherein the resilient material is so selected that on the one hand it gives sufficient resistance to deformation to hold the tube sheet against the rim and, on the other hand, its load-deformation characteristics are such that for the deformations resulting from differences in thermal expansion the stress levels in the critical parts remain acceptable.

SUMMARY OF THE INVENTION

To this end the heat exchanger according to the present invention comprises a circle-cylindrical shell defining a heat-exchange part closed at one end in which heat-exchange tubes are arranged and an open-ended front-end part having an internal diameter which is larger than the internal diameter of the heat-exchange part and being separated therefrom by a rim, a tube sheet located in the front-end part against the rim, a partition box located in the front-end part against the tube sheet comprising a sleeve and a partition-box ring, a key-ring assembly arranged in an annular groove in the shell at the front-end part and provided with threaded passages, a plurality of compression bolts arranged through the threaded passages in the key-ring assembly of which the free ends extend to the partition-box ring, a front-end cover, and fastening means for securing the front-end cover in the open end of the front-end part, wherein the heat exchanger further comprises resilient elements located between the ends of the compression bolts and the partition-box ring, characterized in that the resilient elements comprise compacted graphite or compacted carbon-graphite having a density of between 1,200 and 2,000 kg/m$^3$.

BRIEF DESCRIPTION OF THE DRAWINGS

The FIGURE shows a longitudinal cross-sectional view of part of the heat exchanger of the present invention.

DETAILED DESCRIPTION

The invention will now be described by way if example in more detail with reference to the accompanying drawing.

The heat exchanger 1 comprises a circle-cylindrical shell 2 having a central longitudinal axis 3. The shell 2 defines a heat-exchange part 4 and an open-ended front-end part 5 having an internal diameter which is larger than the internal diameter of the heat-exchange part 4. The open-ended front-end part 5 is separated from the heat-exchange part 4 by a rim 6. The heat-exchange part 4 is closed at the end opposite to the front-end part 5 by a closure member (not shown), such as a spherical head or a cover. In the heat-exchange part 4 several U-shaped heat-exchange tubes 7 are arranged, for the sake of clarity the ends of only one tube is shown.

The heat exchange part 4 is provided with an inlet nozzle (not shown) and an outlet nozzle (not shown). The front-end part 5 is provided with an inlet nozzle 8 and an outlet nozzle (not shown) arranged at the side opposite of the side where the inlet nozzle 8 is arranged.

The heat exchanger further comprises a tube sheet 9 located in the front-end part 5 against the rim 6, wherein between the tube sheet 9 and the rim 6 a seal 11 is arranged, the seal 11 is of a suitable material, such as packing material is arranged. In the tube sheet 9 the end parts of the heat-exchange tubes 7 are secured.

In the front-end part 5 a partition box 12 is arranged against the tube sheet 9. The partition box 12 comprises a sleeve 13 and a partition-box ring 14. The partition box 12 further comprises a partition plate 17 and a semi-circular partition-box cover 19. An inlet chamber 20 is defined between the sleeve 13, the tube sheet 9, the partition plate 17 and the semi-circular partition-box cover 19. The inlet chamber 20 communicates with the inlet nozzle 8 of the front-end part 5 through an opening 23 arranged in the sleeve 13. A sealing-means assembly ensuring fluid to flow from the inlet nozzle 8 into the inlet chamber 20 is not shown. An outlet chamber 24 is defined by the sleeve 13, the tube sheet 9 and the partition plate 17. The outlet chamber 24 communicates with the outlet nozzle (not shown).

To press the partition box 12 against the tube sheet 9, the heat exchanger 1 is further provided with key-ring assembly 30 arranged in an annular groove 31 in the shell 2, which annular groove 31 opens towards the front-end part 5. The key-ring assembly 30 comprises a split key ring 32 provided with passages 33 arranged in the annular groove 31, and a locking ring 35 having a smaller diameter provided with threaded passages 36 which are in a direct line with the passages 33. Through each passage of the key-ring assembly 30 formed by the passages 33 and 36 a compression bolt 38 is arranged. The free ends of the compression bolts 38 extend to the partition-box ring 14. The heat exchanger 1 further comprises resilient elements 39 located between the ends of the compression bolts 38 and the partition-box ring 14. The resilient elements 39 are designed to ensure that the compressive forces exerted on the partition box 12 result in stresses in the partition box 12 which are in the elastic domain, so that the partition box 12 is not compressed in the plastic domain. Other construction elements between the rim 6 and the annular groove 31 may as well be affected, and therefore the design of the resilient elements 39 should be such that the stresses in the relevant elements remain in the elastic domain. The resilient elements are blocks of compacted graphite or compacted carbon-graphite having a density of between 1,200 and 2,000 kg/m$^3$.

The open-ended front end is closed by a front-end cover 40, which is secured by fastening means comprising a ring 41 provided with external threads 42 which is screwed in the threaded part 43 of the shell 2. Means for sealing the front-end cover 40, and for preventing the front-end cover from moving into the heat exchanger are known as such and have not been shown.

During normal operation the shell fluid enters into the heat-exchange part 4 of the shell 2 through an inlet nozzle (not shown) arranged in the shell 2, flows around the heat exchange tubes 7, and leaves the heat-exchange part 4 through an outlet nozzle (not shown) arranged in the shell 2. The tube fluid enters into the heat exchanger 1 through the inlet nozzle 8 arranged in the front-end part 5 of the shell 2 which inlet nozzle 8 communicates with the inlet chamber 20 of the partition box 12. The tube fluid flows from the inlet chamber 20 through the U-shaped heat-exchange tubes 7 to the outlet chamber 24 of the partition box 12, and the tube fluid leaves the heat exchanger 1 through an outlet nozzle (not shown) arranged in the front-end part 5 which outlet nozzle (not shown) communicates with the outlet chamber 24.

Any change in operating conditions, for example during start-up, causes changes in the lengths of the front-end part 5 between the rim 6 and the annular groove 31, of the partition box 12 and of the compression bolts 38. These changes may be such that the partition box 12 and the resilient elements 39 are compressed. As a result of the presence of the resilient elements 39 the partition box 12 will not be subjected to compressive stresses in the plastic domain. Thus the partition box 12 will not be affected by permanent set, and therefore when the new operating conditions are attained the length of partition box 12 will be as designed for the steady-state operating conditions. This applies as well to other construction elements between the rim 6 and the annular groove 31 which may have been affected. Thus the force with which the seal 11 is compressed is not affected, and thus the present invention provides an elegant way of reducing the chance of leakage across the seal 11.

Compacted graphite or compacted carbon-graphite is a porous material with a low density, of which the resilient properties depend on the degree of compaction. It has been found that compacting the material to a density of below 1,200 kg/M$^3$ will result in a material that is too soft and that deforms too much under a given load so that the force with which the tube sheet is kept in place gets below the required level. On the other hand, compacting it to above 2,000 kg/m$^3$ would result in a material that deforms too little so that too high stresses will build up in the metal parts that are to be protected.

Thus this material enables the designer to select the required spring characteristics by selecting the proper density of the material. A suitable lower limit for the density is 1.500 kg/M$^3$.

Suitably, the resilient elements consist of blocks, in an alternative embodiment they may be parts of a ring compacted graphite or compacted carbon-graphite.

What is claimed is:

1. A heat exchanger comprising:

a circle-cylindrical shell defining a heat-exchange part closed at one end and having an inside surface defining an internal diameter, and an open-ended front-end part having an inside surface defining an internal diameter which is larger than the internal diameter of the heat-exchange part;

a rim separating the heat-exchanger part from the front-end part;

a tube sheet located in the front-end part against the rim;

heat-exchange tubes arranged in the heat-exchanger part of the shell, said heat-exchanger tubes connected to said tube sheet;

a partition box located in the front-end part against the tube sheet comprising a sleeve and a partition-box ring;

a key-ring assembly arranged in an annular groove in the shell at the front-end part and provided with threaded passages;

a plurality of compression bolts, each having a head and a free end, arranged through the threaded passages in the key-ring assembly of which the free ends extend to the partition-box ring;

a front-end cover; and fastening means for securing the front-end cover in the open end of the front-end part;

wherein the heat exchanger further comprises resilient elements located between the free ends of the compression bolts and the partition-box ring, said resilient elements comprising compacted graphite or compacted carbon-graphite.

2. The heat exchanger according to claim 1 wherein the compacted graphite or compacted carbon-graphite of the resilient elements has a density of between 1.200 and 2.000 kg/m$^3$.

3. In a heat exchanger comprising a circle-cylindrical shell defining a heat-exchange part closed at one end in which heat-exchange tubes are arranged and an open-ended front-end part having an internal diameter which is larger than an internal diameter of the heat-exchange part and being separated therefrom by a rim, a tube sheet located in the front-end part against the rim, a partition box located in the front-end part against the tube sheet comprising a sleeve and a partition-box ring, a key-ring assembly arranged in an annular groove in the shell at the front-end part and provided with threaded passages, a plurality of compression bolts, each having a head and a free end, arranged through the threaded passages in the key-ring assembly of which free ends extend to the partition-box ring, a front-end cover, and fastening means for securing the front-end cover in the open end of the front-end part, the improvement comprising resilient elements located between the free ends of the compression bolts and the partition-box ring, said resilient elements comprising compacted graphite or compacted carbon-graphite having a density of between 1.200 and 2.000 kg/m$^3$.

* * * * *